United States Patent [19]

Osono et al.

[11] Patent Number: 4,940,353

[45] Date of Patent: Jul. 10, 1990

[54] HOLDER FOR PAPER-KEEPING BAGS

[75] Inventors: Katuo Osono; Masaaki Maejima, both of Tokyo, Japan

[73] Assignee: King Jim Co., Ltd., Tokyo, Japan

[21] Appl. No.: 223,987

[22] Filed: Jul. 25, 1988

[30] Foreign Application Priority Data

Dec. 28, 1987 [JP] Japan ..... 62-330139

[51] Int. Cl.[5] ..... B42F 13/14

[52] U.S. Cl. ..... 402/79; 402/52

[58] Field of Search ..... 402/79, 54, 48, 52, 402/55, 56, 57, 70, 71, 74, 75

[56] References Cited

U.S. PATENT DOCUMENTS

| | | | |
|---|---|---|---|
| 1,364,973 | 1/1921 | Averill | 402/52 |
| 4,551,039 | 11/1985 | Basseches | 402/79 X |
| 4,820,075 | 4/1989 | Osono | 402/79 |

FOREIGN PATENT DOCUMENTS

| | | | |
|---|---|---|---|
| 474281 | 3/1929 | Fed. Rep. of Germany . | |
| 521358 | 3/1931 | Fed. Rep. of Germany | 402/79 |
| 333231 | 8/1930 | United Kingdom . | |

*Primary Examiner*—Paul A. Bell

*Attorney, Agent, or Firm*—Young & Thompson

[57] ABSTRACT

A holder for paper-keeping bags is disclosed, which comprises an elastic sleeve with U-shaped transverse section open at along one longitudinal side, a sliding bind base inserted into the elastic sleeve slidably in the longitudinal direction, a board bonded at one side edge adhesive portion of the sliding bind base and a plurality of paper-keeping envelopes held in layers at one side edge holder portion of the board. The sliding bind base is provided at a predetermined distance apart from each other along its longitudinal direction with L-shaped guide grooves and binding apertures connected thereto for inserting binding rods sideward, while the elastic sleeve is provided with engagement grooves for opening or closing the binding apertures in transverse portions of the L-shaped guide grooves, the transverse portions and engagement grooves being so constructed that the last ones thereof positioned in the sliding direction for closing the binding aperture of the sliding bind base are slant grooves open to the sliding direction.

4 Claims, 5 Drawing Sheets

HOLDER FOR PAPER-KEEPING BAGS

FIELD OF THE INVENTION

This invention relates to a holder for paper-keeping envelopes capable of filing in one lot a fixed number of envelopes for sortably keeping papers such as documents, catalogues, reports and invoices.

BACKGROUND OF THE INVENTION

There have been known some paper-keeping envelopes for filing use capable of conveniently sorting and filing the papers, for instance, under the Japanese Utility Model Publication No. 56-18461. Such paper-keeping envelopes, however, generally comprise one envelope, so that it was impossible to sort a comparatively great number of classified papers into smaller groups and keep them in order.

In view of the foregoing, the applicant has already devised a holder for paper-keeping envelopes 10 as shown in FIG. 7 and filed a utility model application under the Japanese Utility Model Application No. 61-198772. This holder of paper-keeping envelopes 10 comprises a board 14 provided with a binding portion 12 at its one end and a sliding member 16 for slidably closing the binding portion 12, said board 14 being capable of holding a plurality of paper-keeping envelopes 18. As apparent from FIG. 8, the binding portion 12 is provided with binding apertures 20 with an insertion guide groove, while the sliding member 16 is provided with engagement grooves 22 corresponding to the binding apertures 20. In a closed condition as shown in FIGS. 7 and 8(*a*), the binding aperture 20 is closed by the engagement groove 22. In an open condition wherein the disposed member 16 is sliding as shown in FIG. 8(*b*), on the other hand, the binding aperture 20 is released, so that the holder of paper-keeping envelopes 10 may be removed from the binding rod 24.

Accordingly, the holder of paper-keeping envelopes 10 is capable of sorting a comparatively great number of papers into small groups to keep in each paper-keeping envelope 18. On filing a holder of paper-keeping envelopes 10*a*, as shown in FIG. 9, a pulling member 26*a* thereof is pulled so as to slide a sliding member 16*a* to its released position or the position as shown in FIG. 8(*b*), so that the holder of paper-keeping envelopes 10*a* may be removed from the binding rod 24, resulting easy removal from the file.

The holder of paper-keeping envelopes 10 as hereinbefore described, however, has the following disadvantages.

Namely, as apparent from FIG. 9, in order to file the holder of paper-keeping envelopes 10*a*, the pulling member 26*a*must be selected before pulling, which requires a considerable time because all the pulling members 26 of the holders of paper-keeping envelopes 10 are concentrated at the bottom portion of a file fixture 28. Furthermore, this often results in an erroneous selection. The sliding member 16*a*, on the other hand, is connectingly pushed from the both sides thereof by the sliding member 16 of each holder of paper-keeping envelopes 10, thereby requiring a considerably strong tensile power for operating the pulling member 26*a*. Such disadvantages increase in proportion to the number of holders of paper-keeping envelopes. These disadvantages generally are common problems occurring in paper-keeping envelopes of this type.

Accordingly, the invention aims to provide a holder of paper-keeping envelopes capable of keeping a comparatively great number of papers sortably in small groups and further of conveniently filing removably these envelopes in one thick file.

SUMMARY OF THE INVENTION

In order to achieve the above object, the invention provides a holder of paper-keeping envelopes comprising an elastic sleeve with U-shaped transverse section open along its one longitudinal side, a sliding bind base inserted into the elastic sleeve slidably in the longitudinal direction, a board bonded at one side edge adhesive portion of the sliding bind base and a plurality of paper-keeping envelopes held in layers at one side edge holder portion of the board, wherein the sliding bind base is provided at a predetermined distance apart from each other along its longitudinal direction with L-shaped guide grooves and binding apertures connected thereto for inserting binding rods sideward, while the elastic sleeve is provided with engagement grooves for opening or closing the binding apertures across portions of the L-shaped guide grooves, said portions and said engagement grooves being so constructed that the last ones thereof positioned in the sliding direction for closing the binding aperture of the sliding bind base are slant grooves open to the sliding direction.

In this case, the elastic sleeve may preferably include a downward engagement rim at the free end of the longitudinal direction of an upper plate and an upward engagement rim at the free end of the longitudinal direction of a lower plate, said upper plate and/or said lower plate being provided in their inner faces at a predetermined distance from each other with a pair of engagement dents for defining open and closed positions toward the engagement grooves, while the sliding bind base is so constructed that the upper face thereof may be provided with a slide contact step portion for slidably contacting with the downward engagement rim, that the end face of the adhesive portion thereof may be a slide contact end face for slidably contacting with the upward engagement rim, and that the upper and/or lower faces thereof are provided at their predetermined position with an engagement protrusion for engaging with the engagement dents.

Furthermore, the board at its outer side edge may be provided with an index portion, while the elastic sleeve and sliding bind base respectively may be integrally formed.

A holder of paper-keeping envelopes comprises a plurality of paper-keeping envelopes, for sorting a comparatively great number of papers into small groups and keeping them in one lot. Furthermore, this holder of paper-keeping envelopes is so constructed that the sliding bind base may slide toward the elastic sleeve for engaging with the binding rod, so that the filing operation may be readily carried out by pushing or pulling the board bonded to the sliding bind base. Since the width direction portion of the guide groove and the engagement groove arranged at their predetermined position slant in a fixed direction, there will be a smooth and reliable removal of the holder of paper-keeping envelopes from the binding rod.

For better understanding, the invention will now be described hereinbelow in more detail with reference to the accompanying drawings.

PREFERRED EMBODIMENTS OF THE INVENTION

Figure 1:
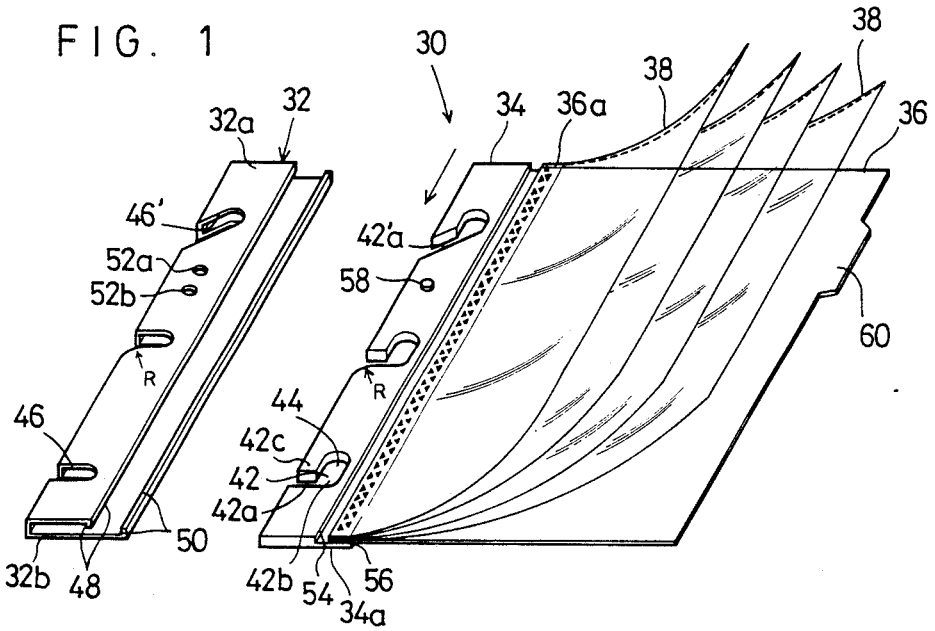
FIG. 1 is a disassembled perspective view of one embodiment of a holder of paper-keeping envelopes according to the invention.
Figure 2:
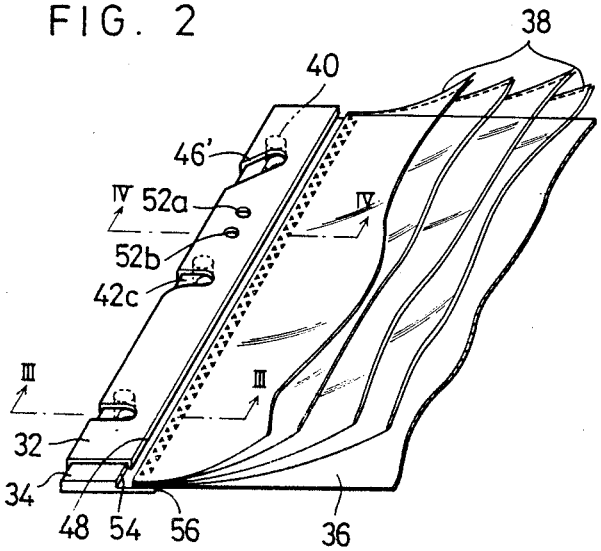
FIG. 2 is a perspective view of the main portions for illustrating an assembled state of the holder of paper-keeping envelopes of FIG. 1.

As shown in FIGS. 1 and 2, a holder of paper-keeping envelopes 30 according to the invention comprises an elastic sleeve 32 with U-shaped transverse section open along one longitudinal side, a sliding bind base 34 inserted into the elastic sleeve 32 slidably in the longitudinal direction, a board 36 bonded at one side edge adhesive portion 34*a* of the sliding bind base 34 and a plurality of paper-keeping envelopes 38 held in layers at one side edge holder portion 36*a* of the board 36. Further, the board 36 at its outer side edge may preferably be provided with an index portion 60.

Figure 3:
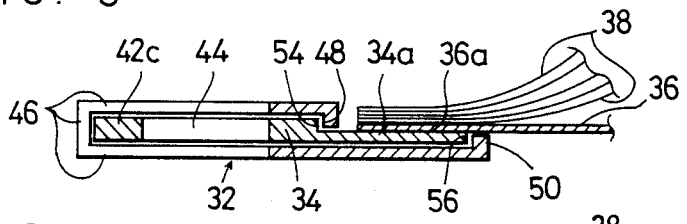
FIG. 3 is an enlarged sectional view taken along III—III line of FIG. 2.
Figure 4:
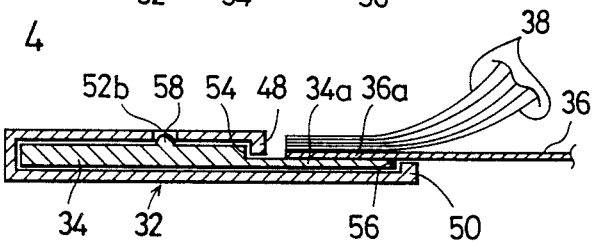
FIG. 4 is an enlarged sectional view taken along IV—IV line of FIG. 2.

The elastic sleeve 32, as enlargedly shown in FIGS. 3 and 4, includes a downward engagement rim 48 along the free longitudinal edge of an upper plate 32*a* and an upward engagement rim 50 along the free longitudinal edge of a lower plate 32*b*, said upper plate 32*a* at its inner face being provided at a predetermined distance apart from each other with a pair of engagement dents 52*a*, 52*b*. The sliding bind base 34, on the other hand, is so constructed that the upper face thereof may be provided with a slide contact step portion 54 for slidably contacting with the downward engagement rim 48, that its one end face or the end face of the adhesive portion 34*a* of the board may have a slide contact end face 56 for slidably contacting with the upward engagement rim 50, and that the upper face thereof may be provided with an engagement protrusion 58 for engaging with the engagement dents 52*a*, 52*b*. Furthermore, the engagement dents 52*a*, 52*b* and the engagement protrusion 58 may preferably be arranged at the lower faces of the elastic sleeve 32 and the sliding bind base 34 respectively or at the upper and lower faces thereof. The elastic sleeve 32 and the sliding bind base 34 each may preferably be formed integrally.

When the sliding bind base 34 thus constructed is inserted into the elastic sleeve 32, the downward engagement rim 48 with the slide contact step portion 54 and the upward engagement rim 50 with the slide contact end face 56 are slidably moved till the engagement protrusion 58 is engaged with either of the engagement dents 52*a*, 52*b*.

Furthermore, the sliding bind base 34 is provided along its longitudinal direction at a predetermined distance corresponding to the binding rods 40 (three binding rods 40 in this embodiment) with L-shaped guide grooves 42 and binding apertures 44 connected thereto for inserting binding rods 40 sideward, said L-shaped guide grooves 42 comprising a transversely extending portion 42*a* and a longitudinally extending portion 42*b*, while the elastic sleeve 32 is provided with engagement grooves 46 for overlapping the transverse portions 42*a* of the L-shaped guide grooves. The last ones (the highest ones in FIGS. 1 and 2) among the transverse portions 42*a* of the L-shaped guide grooves and the engagement grooves 46 positioned in the sliding direction (the direction following an arrow in FIG. 1) for closing the binding aperture 44 of the sliding bind base 34 are formed as slant grooves 42*a*', 46' open to the sliding direction respectively, while the middle ones thereamong may preferably be constructed so that their corner portions of the sliding direction may be portions of radius R.

Figure 6:
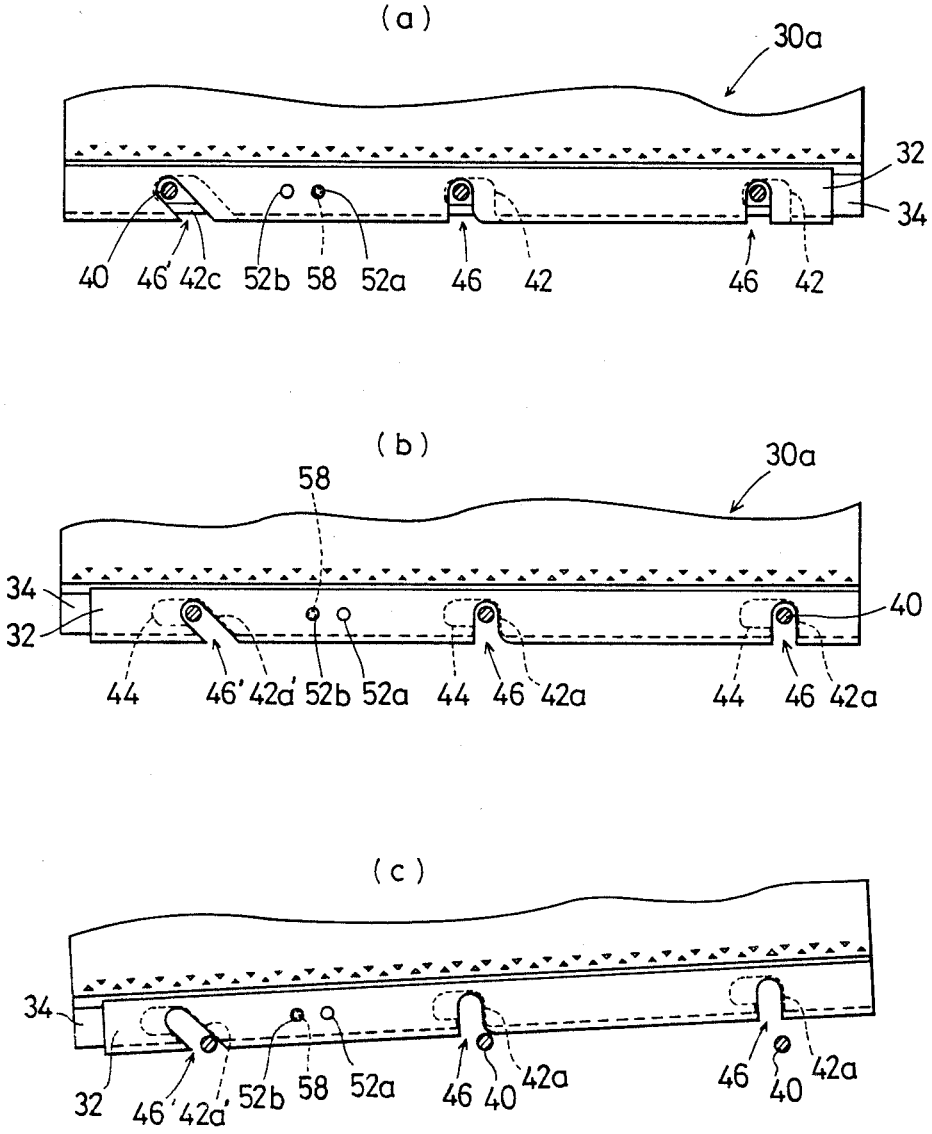
FIGS. 6(*a*), (*b*) and (*c*) are plan views respectively of a closed condition, a released condition and a removed condition of a binding rod for illustrating relations between a binding rod and a binding aperture.
Figure 7:
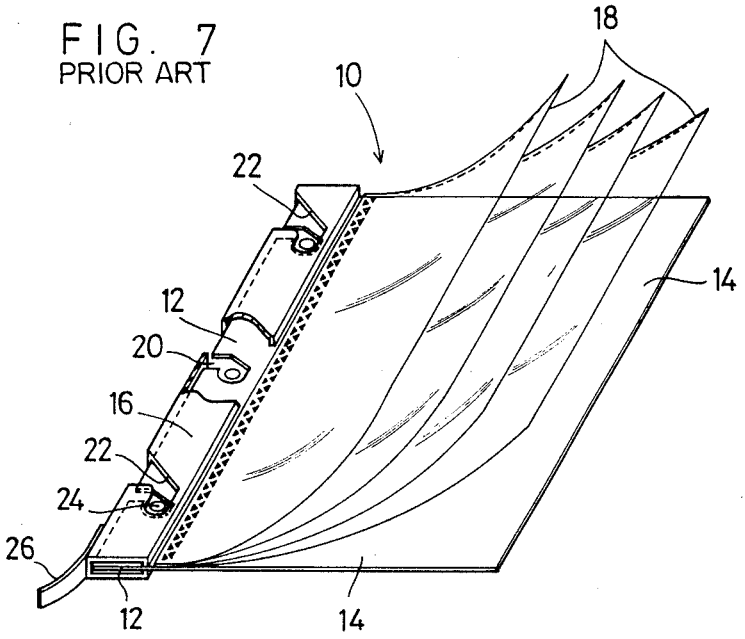
FIG. 7 PRIOR ART
FIG. 7 is a perspective view of a conventional holder of paper-keeping envelopes.
Figure 8:
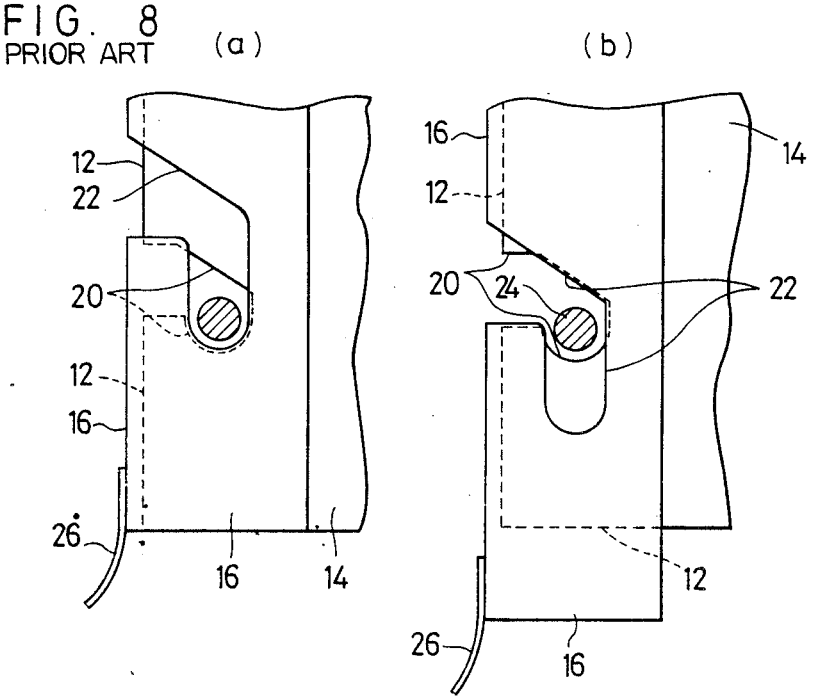
FIG. 8 PRIOR ART
FIGS. 8(*a*) and (*b*) are enlarged plan views respectively of a closed condition and a released condition of a binding rod for illustrating relations between a binding rod and a binding aperture of the holder of paper-keeping envelopes of FIG. 7.
Figure 9:
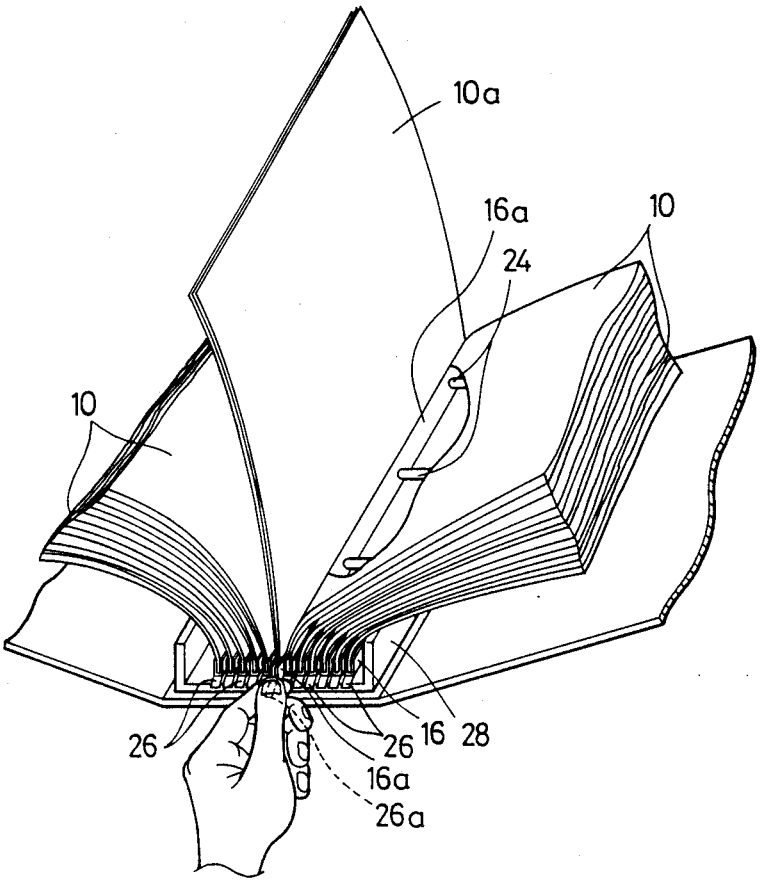
FIG. 9 PRIOR ART
FIG. 9 is a perspective view for explaining the filing operation of the holder of paper-keeping envelopes of FIG. 7.

When the engagement protrusion 58 is engaged with the engagement dent 52*b* at a closed position (see FIGS. 2 and 6(*a*) as hereinafter described), the binding rod 40 positioned in the binding aperture 44 is held within the engagement groove 46 by a protrusion 42*c* of the L-shaped guide groove 42 so as to be retained within the binding aperture 44. When the sliding bind base 34 is slid to engage the engagement protrusion 58 with the engagement dent 52*a* at an open condition (see FIGS. 6(*b*) and (*c*)), on the contrary, the transverse portion 42*a* of the L-shaped guide groove 42 corresponds with the engagement groove 46, permitting removal of the sliding bind base 34 or the holder of paper-keeping envelopes 30 from the binding rod 40.

The operation of the holder of paper-keeping envelopes 30 according to the invention will be described below.

Figure 5:
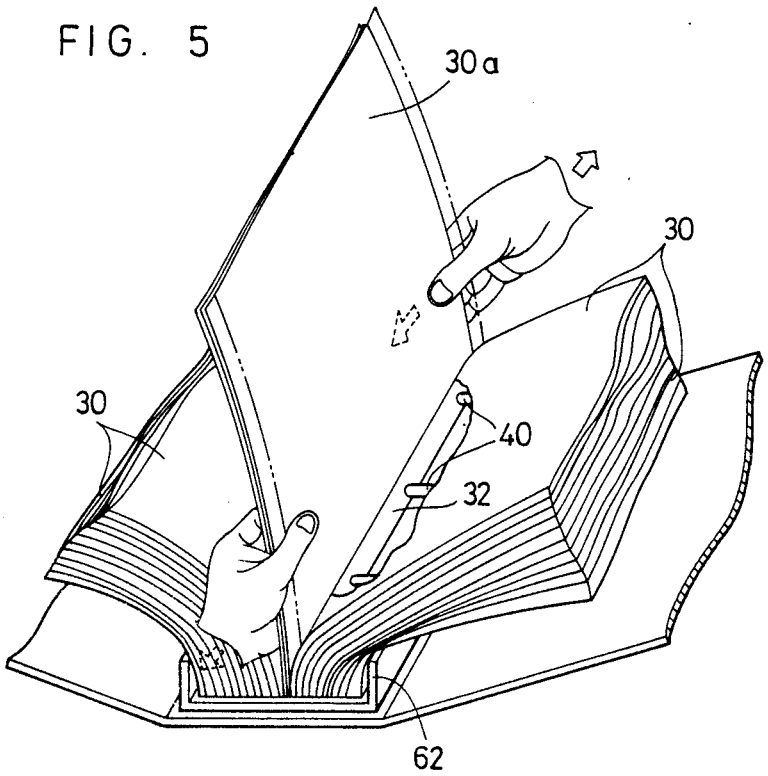
FIG. 5 is a perspective view for explaining the filing operation of the holder of paper-keeping envelopes of FIGS. 1 and 2.

Referring to FIG. 5, before pulling out a holder of paper-keeping envelopes 30*a* required for instance from many holders of paper-keeping envelopes 30 bound in the file fixture 62, an end portion of the holder of paper-keeping envelopes 30*a* must be handled. Under this condition, the sliding bind base 34, as shown in FIG. 6(*a*), is arranged at a closed position toward the elastic sleeve 32 or at the position wherein the engagement protrusion 58 is engaged with the engagement dent 52*b*, while the binding rod 40 is enclosed within the binding aperture 44. Then, the holder of paper-keeping envelopes 30*a* is pulled in the direction following an arrow as shown by a solid line in the figure. Subsequently, the sliding bind base 34 is slidably moved within the elastic sleeve 32 to a released position as shown in FIG. 6(*b*) or until the engagement protrusion 58 is engaged with the engagement dent 52*a*. In this condition, the transverse portion 42*a* of the L-shaped guide groove 42 of the sliding bind base 34 corresponds with the engagement groove 46 of the elastic sleeve 32, thereby permitting removal of the holder of paper-keeping envelopes 30*a* from the binding rod 40. Therefore, by further pulling under this condition, the holder of paper-keeping envelopes 30*a* is guided by means of the slant grooves 46', 42a' so as to be liftingly pulled out from the back portion thereof, as shown in FIG. 6(c).

When the holder of paper-keeping bags 30a is inserted, as shown by a two-dotted line in FIG. 5, it is moved somewhat to a set position (in the direction following an arrow illustrated by a broken line). In this case, it may be handled anywhere as shown in the figure. Then, the binding rod 40, as shown in FIG. 6(c), is succesively inserted through the slant grooves 46', 42a' into the binding aperture 44 to be set at the position as shown in FIG. 6(b). Another pull in the direction following an arrow under this condition allows the sliding bind base 34 to slide within the elastic sleeve 32 to a closed position as shown in FIG. 6(a) or until the engagement protrusion 58 is engaged with the engagement dent 52a, thereby enclosing the binding rod 40 within the binding aperture 44 by the protrusion 42c of the L-shaped guide groove 42. When the sliding bind base 34 is sliding, the base is securely engaged with the binding rod 40 through the slant grooves 46', 42a', thereby preventing the sliding bind base 34 from misguidedly slipping out of the binding rod during sliding.

Thus, in the holder of paper-keeping envelopes according to the invention the sliding bind base is constructed so as to move slidably toward the elastic sleeve, so that the filing operation of the holder of paper-keeping envelopes may be carried out by pushing or pulling the board or the holder body of paper-keeping envelopes. Furthermore, the filing operation may be carried out almost without touching adjacent holders of paper-keeping envelopes, resulting in easy and reliable operation. The holder of paper-keeping envelopes comprises a plurality of envelopes, thereby sorting a comparatively great number of papers into small groups and keeping them in one lot.

From the foregoing, the holder of paper-keeping envelopes according to the invention comprises an elastic sleeve, a sliding bind base inserted thereinto, a board bonded thereto and a plurality of the paper-keeping envelopes held thereby in layers wherein some of L-shaped guide grooves and engagement grooves provided so as to open or close binding apertures for inserting binding rods are formed as slant grooves, thereby permitting sorting comparatively great numbers of classified papers into smaller groups and keeping them in one lot. Therefore, the filling operation thereof may smoothly and securely be carried out by pushing or pulling the holder body almost without touching adjacent holders of paper-keeping bags.

Although the invention has been described hereinbefore with its preferred embodiments, it will be appreciated that many variations and modifications may be made without departing from the spirit and scope of the invention.

What is claimed is:

1. A holder of paper-keeping envelopes comprising an elastic sleeve (32) with U-shaped transverse section open along its one longitudinal side, a sliding bind base (34) inserted into the elastic sleeve (32) slidably in the longitudinal direction, a board (36) bonded at one side edge adhesive portions (34a) of the sliding bind base (34) and a plurality of paper-keeping envelopes (38) held in layers at one side edge holder portion (36a) of the board (36), wherein the sliding bind base (34) is provided at a predetermined distance apart from each other along its longitudinal direction with L-shaped guide grooves (42) and binding apertures (44) connected thereto for receiving posts of a binder, while the elastic sleeve (32) is provided with engagement grooves (46) for opening or closing the binding apertures (44) in transverse portions (42a) of the L-shaped guide grooves (42), said transverse portions (42a) and said engagement grooves (46) being so constructed that the trailing ones thereof when sliding the bind base (34) for closing the binding aperture of the sliding bind base (34) are slant grooves (42a', 46') open to the sliding direction and the forward ones thereof are transverse grooves (42a, 46) disposed at a substantially greater angle to the length of said sleeve (32) and bind base (34) than are said slant grooves (42a', 46').

2. A holder of paper-keeping envelopes according to claim 1, wherein the elastic sleeve (32) includes a downward engagement rim (48) along a longitudinal free edge of an upper plate (32a) and an upward engagement rim (50) along a longitudinal free edge of a lower plate (32b), said upper plate (32a) and/or said lower plate (32b) being provided in their inner faces at a predetermined distance from each other with a pair of engagement dents (52a, 52b) for defining open and closed positions of the engagement grooves (46), while the sliding bind base (34) is so constructed that the upper face thereof has a slide contact step portion (54) for slidably contacting with the downward engagement rim (48), the end face of the adhesive portion (34a) thereof having a slide contact end face (56) for slidably contacting the upward engagement rim (50), and the other of said upper plate (32a) and/or said lower plate (32b) having an engagement protrusion (58) for engaging with the engagement dents (52a, 52b).

3. A holder of paper-keeping envelopes according to claim 1, wherein the board (36) at its outer side edge is provided with an index portion (60).

4. A holder of paper-keeping envelopes according to claim 1, wherein the elastic sleeve (32) and the sliding bind base (34) are integrally formed.

* * * * *